United States Patent [19]

Bex

[11] 4,034,316

[45] July 5, 1977

[54] CIRCUIT ARRANGEMENT IN STRIP LINE TECHNIQUE FOR A WIDE BAND BALANCING ELEMENT

[75] Inventor: Hans Bex, Aachen, Germany

[73] Assignee: U.S. Philips Corporation, New York, N.Y.

[22] Filed: Oct. 7, 1975

[21] Appl. No.: 620,299

[30] Foreign Application Priority Data

Oct. 22, 1974 Germany ..... 2449999

[52] U.S. Cl. ..... 333/11; 333/84 M

[51] Int. Cl.² ..... H01P 5/22

[58] Field of Search ..... 333/11

[56] References Cited

UNITED STATES PATENTS

| | | | |
|---|---|---|---|
| 2,789,271 | 4/1957 | Budenbom | 333/11 |
| 3,346,822 | 10/1967 | Levy et al. | 333/11 X |

*Primary Examiner*—Paul L. Gensler

*Attorney, Agent, or Firm*—Frank R. Trifari

[57] ABSTRACT

For the purpose of increasing the bandwidth the hybrid ring which is known per se is extended by means of half a ring having a specific optimum length. The arrangement can be readily produced in the fold stripline technique.

2 Claims, 2 Drawing Figures

CIRCUIT ARRANGEMENT IN STRIP LINE TECHNIQUE FOR A WIDE BAND BALANCING ELEMENT

The invention relates to a circuit arrangement in strip line technique for a wide band balancing element in the form of a hybrid ring.

Such hybrid rings are used in the high frequency technique as balancing elements and produced in the form of strip lines. A base plate is used for this purpose consisting of an $Al_2O_3$ substrate. One of the faces of this base plate may be entirely provided with a counter electrode which is connected to a common reference point and which may also be used for shielding purposes. The conductors which are arranged in the form of strips on the unoccupied face, also called strip lines or conductor paths for short serve in their arrangement widely different purposes. Strip lines and especially balancing elements are described in the article "Streifenleitungen — Einführung in die Theorie und Technik bei Höchstfrequenzen" by H. Geschwinde and W. Krank — Wintersche Verlagsbuchhandlung — Füssen 1960, pages 82 etc. The description of hybrid rings can also be found in the publication "Internationale Elektronische Rundschau" 1969, volume 23, pages 225 to 229.

The hybrid ring known from the latter publication has one input gate and three output gates. This arrangement is also called $\pi$-hybrid branching. The one first output gate is moved $3\lambda/4$ on the ring with respect to the input gate, namely clockwise, while the other second output gate is located on the ring moved $\lambda/4$ anticlockwise. Between these two output gates, so at a distance of $\lambda/4$ from both the first and also the second output gate there is a third output the so-called insulated output.

If a high-frequency wave in the GHz range, for example at a mid-band frequency of 2 GHz is applied to gate 1 in this hybrid ring, then it is possible to derive from each output gate a high-frequency wave and these waves are shifted 180° with respect to one another. However, they can only individually be passed on for further processing. It is, however, also possible, to combine the two output gates, so to interconnect them and then a pushpull wave is obtained. When only one hybrid ring is used, the transmittable bandwidth is relatively narrow. When designed optimally it is, with reference to the midband frequency approximately 40% in the 3GHz range. (H. Geschwinde and W. Krank as specified above, page 82 last sentence). In this respect it is important on the bases of which criteria this value was measured. The known arrangement shows a four-gate and measurements are usually made by means of the decoupling between gate 1 and gate 2 or at the so-called insulated output respectively. By way of example, 20 dB is taken as reference value in the representation "insulation as function of the frequency". This causes the relatively high bandwidth values.

Furthermore it is known from the publication "Correspondence of the IEEE Trans. on MTT", August 1968, pages 560 to 562, page 561 FIG. 1, 2 and 3 in particular, to give a strip line a special form at the bends.

It was an object of the invention to improve the known hybrid ring arrangement, namely the bandwidth must be increased whilst maintaining the same number of input and output gates.

To satisfy this requirement, measures were taken for the circuit arrangement mentioned hereinbefore, which are further described in the characteristic of patent claim 1. In a further embodiment of the invention, measures were taken as described in the characteristics of the sub claims.

An embodiment of the invention is further explained with reference to the drawing in which.

Figure 1:
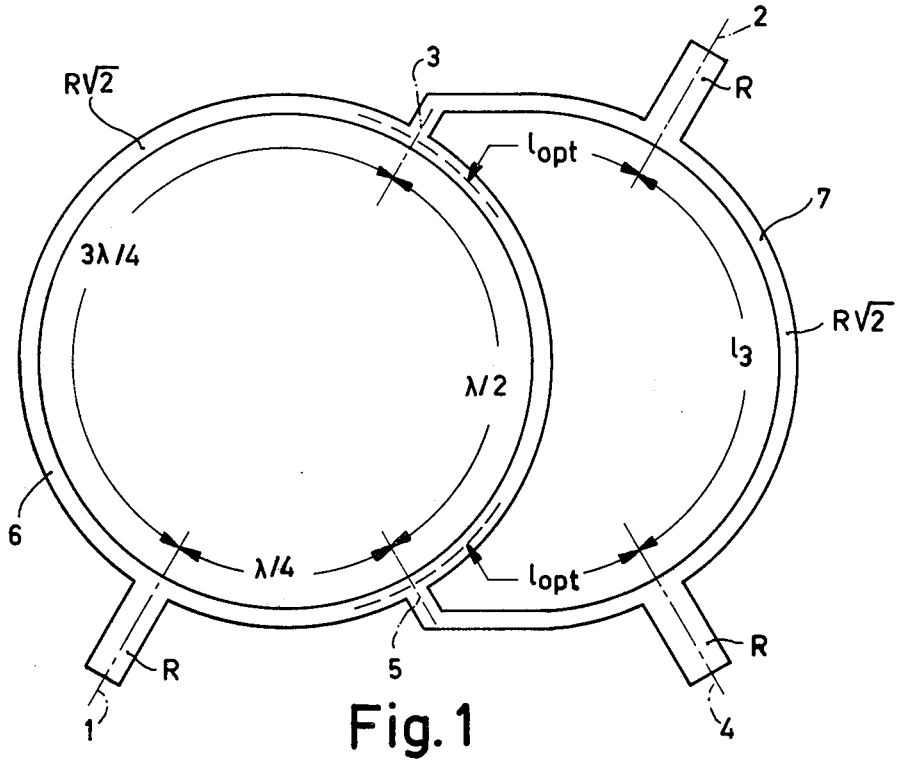
FIG. 1 shows an extended hybrid ring according to the invention.

FIG. 1 shows the, in itself, known hybrid ring 6 with an input gate 1, a first output gate 3, moved clockwise over $3\lambda/4$ and a second output gate 5, moved anticlockwise over $\lambda/4$. Consequently the distance between the first output gate 3 and the second output gate 5 is $\lambda/2$. According to the invention this known ring is now extended with the partial ring, which is connected to said two output gates 3 and 5 so that these output gates may now be considered as interconnecting gates. Further additional output gates 2 and 4 are provided arranged along the partial ring 7 each at a distance $l$ opt of the first or second interconnecting gate. The distance on the partial ring 7 between the two additional output gates 2 and 4 is $l$ 3.

These shown strip lines or conductors respectively are arranged on an $Al_2O_3$-substrate which is fully metallized on the unoccupied face. The width of the conductors is determined by the required wave resistance, which is indicated in FIG. 1 by R and R $\sqrt{2}$ respectively. The length of the conductors is approximately determined by the wavelength $\lambda$ of the midband frequency.

The arrangement shown, according to the invention, solves the problem that of a high frequency wave supplied to an input of the input gate 1, i.e. of the real power of this wave one half (3 dB) arrives each time at the additional output gate 2 and 4, which is known per se, a 180° phase shift occurring simultaneously between the output signals, which are of equal magnitude at the additional output gates 2 and 4, only, in this arrangement according to the invention, the bandwidth is considerably increased.

The bandwidth for such a balancing element is in the literature not uniformly defined, as explained hereinbefore. Here the following definition is used: with respect to a distribution attenuation of the output signals of 3 dB each at additional gate 2 and additional gate 4 a deviation of ± 1 dB is permitted. At the same time the phase angle of the one output signal to the other may then deviate ± 10° from 180°, which means that the phase deviation of a signal is 10° for the largest deviation in the symmetry and the losses may amount to 2 dB. Then the following equations must apply:

Equation I $0.63 \leqq |S21| \leqq 0.78$,
Equation II $0.63 \leqq |S41| \leqq 0.78$ and
Equation III $\leqq ||\arg S21 - \arg S41| - 180°| \leqq 10°$ where $|S21|$ and $|S41|$ are the values of the transmission factors of the two output signals and arg $S21$ and arg $S41$ the phase angle of the two signals $S21$ and $S41$. At a desired mid-frequency of 2.5 GHz and a wave resistance of 50Ω a hybrid ring - arranged on an $Al_2O_3$-substrate - attains, according to the state of the art a bandwidth of approximately 30% with respect to the midband frequency.

The criteria as specified in equation I to III have here been taken as basis. So, compared with the bandwidths explained hereinbefore which are measured on the basis of other criteria, deviating, namely smaller, values occur as also specified in "Internationale Elektronische Rundschau" 1969, page 228.

Figure 2:
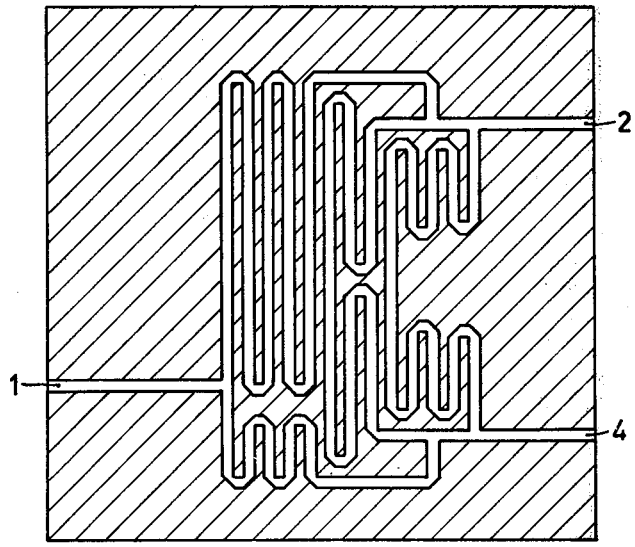
FIG. 2 shows an embodiment of the hybrid ring of FIG. 1 in fold technique.

The extended hybrid ring shown in FIG. 1, in the embodiment according to FIG. 2 of the accompanying drawing is constructed on a surface which is smaller than 1 $cm^2$, namely in the so-called fold technique. In the embodiment according to FIG. 2, the wave resistance is R instead of R $\sqrt{2}$ for all conductors. This wave resistance was chosen for the reason that otherwise the thickness of the substrate, i.e. of the $Al_2O_3$ substrate of approximately 0.254 mm would result in conductors which would be too narrow for technological reasons. This results in $l_3 \approx \lambda/2$, for example $l_3 =$ 2.225 cm at $\lambda = 4.625$ cm and $R = 50\ \Omega$ for the dimensions shown in partial ring 7 where $\lambda$ is the mid-band wavelength. A conductor width of approximately 0.2 mm results in a length $l$ opt = 0.077 cm, that is about $\lambda/60$. The bandwidth measured was in this arrangement 1.43 GHz at a mid-band frequency of 2.91 GHz, so that the relative bandwidth was approximately 49.2%, the standing wave ratio VSWR at gates 1, 2 and 4 being smaller than 2.0.

What is claimed is:

1. A circuit arrangement in strip line technique for a wide-band balancing element operating at a mid-band wave length $\lambda$, comprising: a hybrid ring, whose conductors are arranged on a base plate and which comprises an input gate, a first output gate which is moved over $3\lambda/4$ in one direction with respect to this input gate, a second output gate which is moved over $\lambda/4$ in the opposite direction with respect to the input gate, the two output gates of the hybrid ring being interconnected by a partial ring conductor having a length of $2 \times l_{opt} + l_3$ where $l_{opt} \approx \lambda/60$, and including additional output gates each arranged at a distance of the length $l_{opt}$ from said first and second output gates and spaced apart at a distance of the length $l_3$, said partial ring being the only other path between said two output gates.

2. A circuit arrangement as claimed in claim 1, wherein the base plate is an $Al_2O_3$-substrate and the individual strip line conductors, made of vapour-deposited gold are arranged in the fold-technique fashion.

* * * * *